US010738509B2

(12) United States Patent
Pettengill

(10) Patent No.: US 10,738,509 B2
(45) **Date of Patent: *Aug. 11, 2020**

(54) LATCHING SYSTEM FOR A MOTOR VEHICLE WITH ACTUATOR

(71) Applicant: Kiekert AG, Heiligenhaus (DE)

(72) Inventor: Robert S. Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 354 days.

This patent is subject to a terminal disclaimer.

(21) Appl. No.: 15/655,959

(22) Filed: Jul. 21, 2017

(65) Prior Publication Data

US 2019/0024418 A1 Jan. 24, 2019

(51) Int. Cl.

| | |
|---|---|
| ***E05B 81/20*** | (2014.01) |
| ***E05B 83/18*** | (2014.01) |
| ***E05B 79/10*** | (2014.01) |
| ***E05B 77/06*** | (2014.01) |
| ***E05B 81/14*** | (2014.01) |
| *E05B 81/06* | (2014.01) |

(52) U.S. Cl.

CPC ..... *E05B 81/20* (2013.01); *E05B 77/06* (2013.01); *E05B 79/10* (2013.01); *E05B 81/14* (2013.01); *E05B 83/18* (2013.01); *E05B 81/06* (2013.01)

(58) Field of Classification Search

CPC ..... E05B 81/20; E05B 77/06; E05B 79/10; E05B 79/12; E05B 79/14; E05B 79/16; E05B 81/14; E05B 83/18; E05B 83/20; E05B 81/06

USPC ..... 292/336.3

See application file for complete search history.

(56) References Cited

U.S. PATENT DOCUMENTS

| | | | | |
|---|---|---|---|---|
| 2014/0203575 | A1* | 7/2014 | Brickner | E05B 77/12 292/341.17 |
| 2014/0291997 | A1* | 10/2014 | Hunt | E05B 77/06 292/92 |
| 2015/0159408 | A1* | 6/2015 | Hunt | E05B 77/06 292/341.17 |
| 2015/0330111 | A1* | 11/2015 | Dente | B60L 58/12 701/49 |

FOREIGN PATENT DOCUMENTS

DE 10 2015 001 318 A1 8/2016

* cited by examiner

*Primary Examiner* — Nathan Cumar

(74) *Attorney, Agent, or Firm* — Renner, Otto, Boisselle & Sklar, LLP

(57) ABSTRACT

A latching system for a motor vehicle is formed of compact construction, that can manage with a small number of components and, enable bolting and/or opening the motor vehicle conveniently and quickly. The motor vehicle latching system is provided with an actuator and a drive for driving the actuator with a first acceleration and a second acceleration, whereby the actuator adjusts the latching system dependent on acceleration. If the drive accelerates the actuator sufficiently slow, the actuator moves the latching system into a first position. If the drive accelerates the actuator sufficiently quick, the actuator moves the latching system into a second position different from the first position. It is therefore adjusted by the drive dependent on the acceleration. Adjustment takes place quickly and especially conveniently without requiring an excessively large number of components. In particular, bolting and/or opening occurs in a motorized manner.

15 Claims, 4 Drawing Sheets

LATCHING SYSTEM FOR A MOTOR VEHICLE WITH ACTUATOR

The invention relates to a latching system for a motor vehicle. A latching system for a motor vehicle can encompass inter alia a locking mechanism, an activation device for opening of the locking mechanism and a bolting device.

BACKGROUND

A locking mechanism provided for latching of a door or flap in essence comprises a catch and a pawl. The catch can be pivoted from an open position to a closed position with the aid of a locking bolt of a door or a flap. The pawl ratchets the catch in the closed position. The locking bolt can then no longer leave the locking mechanism as the catch can then no longer be pivoted back into its open position. For opening, the pawl must initially be moved out of its ratchet position, i.e. lifted from the catch. The catch can subsequently be pivoted back into its open position. The locking bolt can then leave the locking mechanism and a pertaining door or flap can be opened.

Unratcheting of the locking mechanism is performed with the aid of an activation device. If a pertaining activation device is activated, an associated locking mechanism of a door or flap is unratcheted, i.e. opened. The pertaining door or flap can then be opened.

A motor vehicle latching system can also be bolted. In the bolted state, a locking mechanism can no longer be opened by activation of the activation device. This applies at least to manual activation of an external activation lever. Such an external activation lever can be an external door handle which is therefore accessible from outside.

A latching system can therefore assume different positions such as bolted, unbolted, ratcheted or unratcheted. In order to move a latching system from one position to another, it needs to be adjusted. A mechanism, a device or a component which causes such adjustment is referred to as an actuator hereinafter.

From DE 10 2015 001 318 A1 an activation device for a motor vehicle latch is known which can prevent unintentional opening of a door or a flap in the case of a crash. The activation device encompasses an external activation lever and an inertia lever. The external activation lever and the inertia lever are coupled via a spring in such a way that in the case of sufficiently slight acceleration of the inertia lever a movement of the external activation lever follows in a delay-free manner. With sufficiently great acceleration of the external activation lever, for example caused by forces action on the latching system in the case of a crash, the inertia lever cannot follow the movement of the external activation lever. Consequently, a distance between the inertia lever and the activation lever increases. An additional latch then engages in such a way that the distance previously increased hereby can no longer be decreased. This is used to prevent unscheduled opening of a pertaining locking mechanism in the case of a crash.

SUMMARY

A task of the invention is to provide a latching system for a motor vehicle of compact construction and with a small number of components. In particular, it should be possible to be able to bolt and/or open conveniently and quickly.

The task is solved by a latching system with the characteristics of the first claim. Advantageous designs result from the dependent claims.

To solve the task, a motor vehicle latching system is provided, with an actuator and a drive for driving the actuator with a first acceleration and a second acceleration, whereby the actuator adjusts the latching system dependent on acceleration. If the drive accelerates the actuator sufficiently slowly, the actuator moves the latching system into a first position. If the drive accelerates the actuator sufficiently quickly, the actuator moves the latching system into a second position different from the first position. It is therefore adjusted by the drive dependent on the acceleration. Adjustment takes place quickly and especially conveniently without requiring an excessively large number of components. The drive is for example, an electromotor.

In one design, acceleration of the actuator with the first acceleration resulting in bolting of the motor vehicle latching system. In the bolted position, the latching system, i.e. a locking mechanism of the latching system, cannot be opened by manual activation of an external activation element. Preferably, the latching system can then not also be opened by manual activation of an internal activation element.

The external activation element can also be activated externally if the interior of the motor vehicle is not accessible. The external activation element can be an external door handle that can be moved for opening, for example, can be pivoted. An internal activation element can be activated from the inside of the vehicle, even if the interior is locked. It can involve an internal door handle that can be moved for opening, thus, for example, pivoted. Bolting can thus take place directly and quickly at any time by acceleration with a first acceleration. As bolting is effected by a drive, bolting is conveniently possible.

In one design, acceleration of the actuator with a second acceleration results in opening of the motor vehicle latching system. Opening with the aid of the drive is also possible at any time, in particular if the motor vehicle latching system is bolted. Convenient and quick opening with aid of the drive, i.e. without needing to unbolt the motor vehicle latching system in advance, is therefore possible.

Advantageously, the consequence of using a great acceleration for opening is that a quick and delay-free entry to or exit from the vehicle is possible. The further acceleration provided for adjustment is therefore less than the great acceleration. If, in one design, bolting takes place due to slight acceleration, an associated temporal delay is thus not observed in practice and therefore does not have a detrimental effect on convenience.

In order for adjustment to take place in a technically simple manner dependent on acceleration, in one design the actuator encompasses an inertia mass coupled with an actuator lever by a spring. The actuator lever is then movable by the drive with two different accelerations in order to adjust the latching system in the manner claimed. If the actuator lever is accelerated with sufficiently low speed, the inertia mass and the actuator lever thus act as a rigid body. If the actuator lever is accelerated sufficiently greatly, the inertia mass cannot directly follow the movement of the actuator lever. This acceleration-dependent movement behavior of the inertia mass is used in order to be able to adjust the latching system in different ways solely by different acceleration.

In one design, there can also be three different accelerations in order to be able to adjust in three ways dependent on acceleration. There are then three different positions of the latching system that are assumed solely due to different acceleration.

The motor vehicle latching system encompasses in particular an external activation lever, an inertia mass, an actuator lever and/or an opening lever pivotably mounted on axes. This enables a compact design with a small number of components in particular if all of the stated components are pivotably accommodated by one common axis.

Manual opening of a motor vehicle from the outside via the external activation lever is possible when the motor vehicle latching system is unbolted. The inertia mass can be accelerated dependent on the acceleration of an actuator lever in a delay-free manner or in a temporally delayed manner and this acceleration-dependent movement behavior be used to adjust the motor vehicle latching system in different positions in an acceleration-dependent manner. The actuator lever can be accelerated by a drive with different speeds in order to thus be able to adjust the motor vehicle latching system dependent on acceleration.

There is advantageously a coupling lever pivotably attached to the opening lever. Bolting, manual and/or motorized opening can occur by adjustment of the coupling lever.

In one design, the motor vehicle latching system encompasses the aforementioned external activation element that unratchets a locking mechanism of the latching system by manual activation when the latching system is not bolted. The external activation element is in particular a pivotably accommodated external door handle. Opening can therefore also take place when due to a technical defect no electric current is available for the drive.

In one design, the external activation element has a free lever end, for example, which is moved by activation of the external activation element and which, starting from a starting position of the latching system, transmits the movement by the coupling lever to the opening lever. A locking mechanism of the motor vehicle latching system is unratcheted by this movement of the opening lever. A movement of the external activation element is therefore transmitted by the coupling lever when the latching system, and therefore also the coupling lever, are previously located in a starting position. A bolting option is thus provided in a technically simple manner as for bolting it is sufficient to move the coupling lever into its bolting position, in particular by a specified acceleration of the actuator with the aid of the drive provided.

In one design, the opening lever has two opposite lever arms that can be connected with a locking mechanism for unratcheting. If the opening lever is moved in the direction of the open position, a pertaining locking mechanism is thus unratcheted due to this connection. For example, the connection can occur with the aid of a strut, a rod, a rope or a Bowden cable. At least one of the two lever arms is connected to a locking mechanism of the motor vehicle latching system. In this design, the latching system can be used without constructional modifications regardless of whether a left or a right door of a motor vehicle is to be opened by the latching system. It is only necessary to select the suitable lever arm for connection with the pertaining locking mechanism. The number of drives required is thus kept low.

In the starting position, the coupling lever is advantageously separated from the external activation element by a gap. The coupling lever can then be pivoted with little force expenditure when the latching system is located in its starting position.

The inertia mass preferably encompasses a ramped end by means of which the coupling lever can be pivoted in the direction of the bolting position. Bolting can therefore take place by movement of the inertia mass. This preferably only occurs if the actuator is accelerated sufficiently slightly.

The inertia mass can preferably be coupled with the opening lever for motorized unratcheting of a locking mechanism of the motor vehicle latching system by means of a coupling lever. This preferably only occurs if the actuator is accelerated sufficiently greatly. Motorized unratcheting means that the unratcheting occurs with the aid of the stated drive.

In one design, the inertia mass is coupled with the opening lever for motorized unratcheting of a pertaining locking mechanism. This preferably occurs by pivoting of the coupling lever into an open position if the inertia mass can only follow a greatly accelerated actuator in a delayed manner.

In a technically simple design, the coupling lever can preferably be pivoted into its open position with the aid of a pre-tensioned spring in order to couple the inertia mass with the opening lever for the motorized unratcheting of the locking mechanism.

The invention relates in particular to a system for a tailgate door of a motor vehicle. The latching system can be activated both manually and in a motorized manner. The motor can drive the actuator with two speeds. Slow driving by the motor moves a coupling lever into a bolting position, where the door can no longer be opened by manual activation of the external activation lever. Quick driving by the motor opens the door.

The conversion of the two speeds into different actuator behavior takes place via an inertia mass connected to an actuator lever via a spring.

BRIEF DESCRIPTION OF THE DRAWINGS

The invention is explained in further detail hereafter based drawings of a design example that is not meant to be limiting. The following are shown.

DETAILED DESCRIPTION

Figure 1:
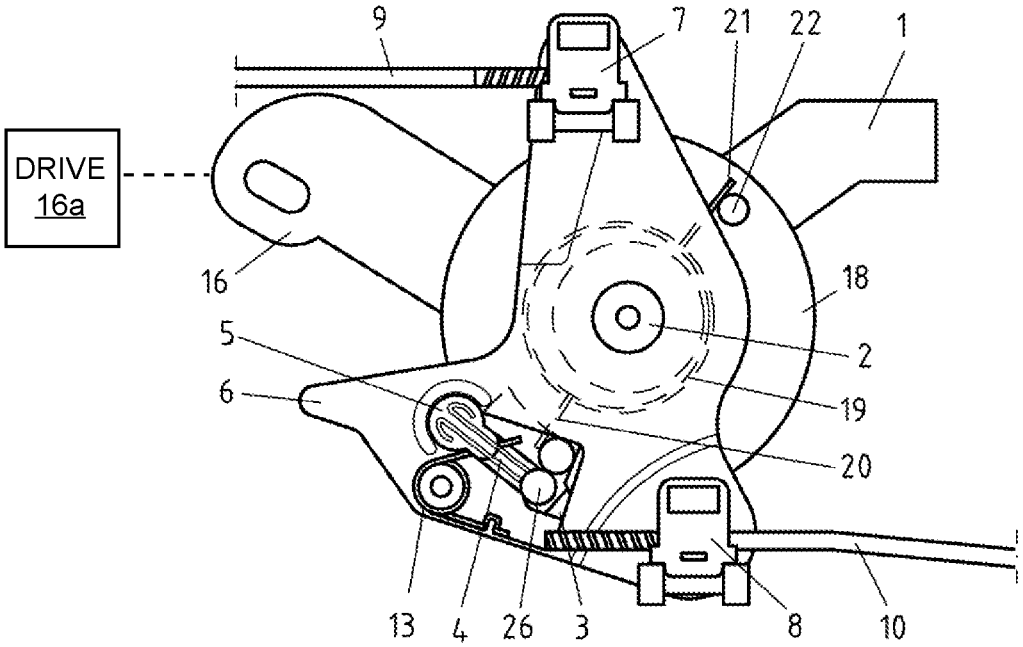
FIG. 1: Activation device of a motor vehicle latching system in a starting position.

FIG. 1 shows an activation device according to the invention in a starting position with an external activation lever 1 pivotably accommodated by an axis 2. The external activation lever 1 can in this position be manually pivoted around the axis 2. The external activation lever 1 has a free lever end 3. If the external activation lever 1 is pivoted around the axis 2 in a clockwise direction, the free lever end 3 captures a coupling lever 4. The coupling lever 4 is pivotably attached to an opening lever 6 via an axis 5.

If the external activation lever 1 has captured the coupling lever 4 by pivoting in a clockwise direction and if it is subsequently pivoted further in a clockwise direction, the external activation lever 1 transmits its rotational movement to the opening lever 6. The opening lever 6 pivotably accommodated by the axis 2 is accordingly also pivoted in a clockwise direction.

At the ends of two opposite lever arms 7 and 8 of the opening lever 6 a rod 9 or a rod 10 can be attached in each instance. Rods 9 and 10 transmit a rotational movement of the opening lever 6 performed in a clockwise direction in such a way on a respective locking mechanism that it is opened. For example, the purpose of one rod 9 is to open a left-side door. The purpose of the other rod 10 is then to open a right-side door. Dependent on the installation situation, the rod 9 or the rod 10 can be present in order to be able to open a left or right door. Advantageously, there are no further modifications of the structure of the activation device necessary in order to adapt the activation device to different doors.

Figure 2:
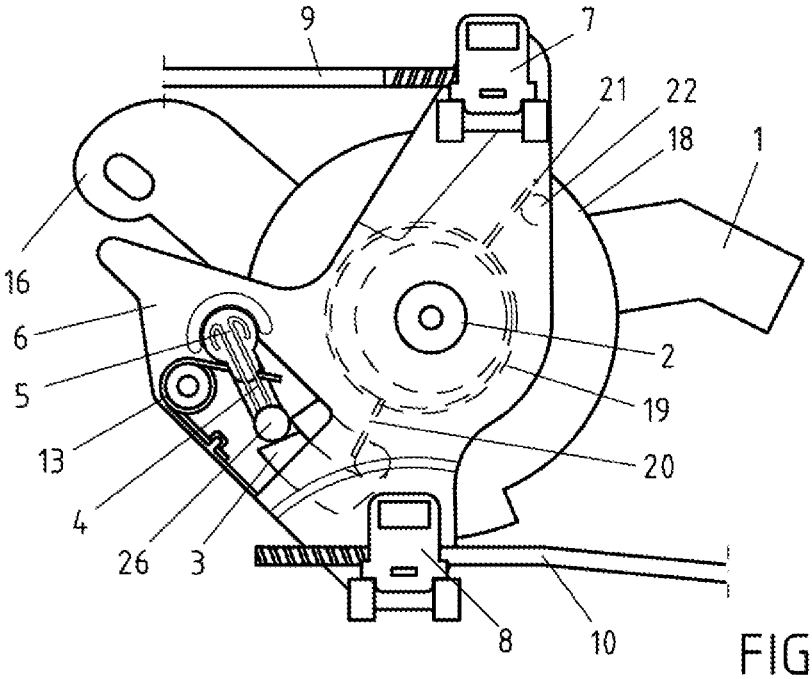
FIG. 2: Opening position after activation of the external activation lever.

FIG. 2 shows the open position which is attained when the external activation lever 1 has been manually pivoted around its axis 2 in a clockwise direction for opening, for example. Connected locking mechanisms are opened by attainment of this end position.

Figure 3:
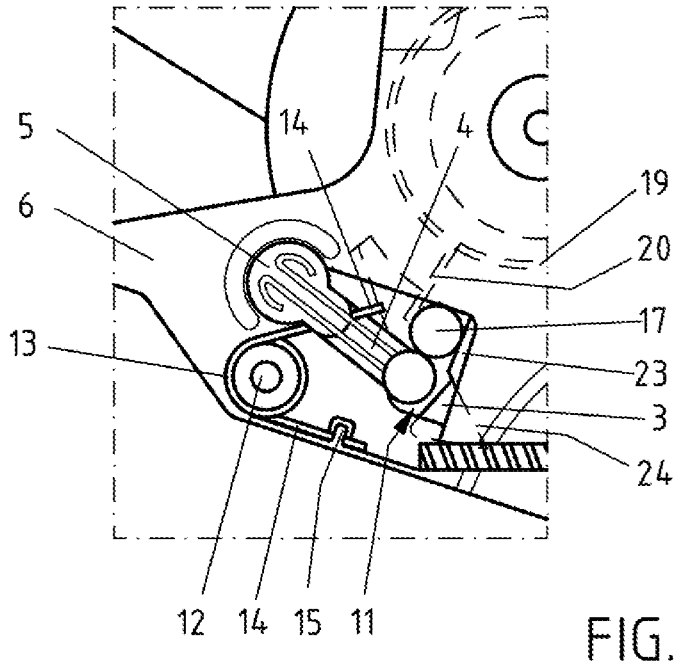
FIG. 3: Enlarged extract from FIG. 1.

FIG. 3 shows an enlarged excerpt from FIG. 1 when the coupling lever 4 is located in its starting position. To enable the coupling lever 4 to be pivoted around its axis 5 in with little force the manner describe, there is a narrow gap 11 between the free lever end 3 of the external activation lever 1 and the coupling lever 4 in the starting position shown in FIG. 1. If the coupling lever 4 is pivoted around its axis 5 in a clockwise direction into its bolting position, a rotational movement of the external activation lever 1 performed in a clockwise direction can no longer be transmitted to the opening lever 6. The relevant doors or flaps are then bolted.

The opening lever 6 has a protruding bolt 12 held by a pre-tensioned leg spring 13. A leg 14 of the leg spring 13 is held by a retaining element 15 of the opening lever 6. The other leg 14 of the leg spring 13 is adjacent on the coupling lever 4. If the coupling lever 4 is pivoted into its bolting position, this thus occurs against the force of a pre-tensioned leg spring 13. The pre-tensioned leg spring 13 therefore enables the coupling lever 4 to be pivoted back into its starting position.

The activation device furthermore has an actuator lever 16 shown inter alia in FIG. 1 encompassing a protruding cam 17. The axis 2 also pivotably mounts the actuator lever 16. On a contour area of the actuator lever 16 close to the cam 17 and the axis 2, the free-moving end of the coupling lever 4 is adjacent in the starting position. The coupling lever 4 is therefore held in its starting position shown in FIGS. 1 to 3 by this contour area close to the axis and by the force of the pre-tensioned leg spring 13.

Furthermore, the activation device has a circular inertia mass 18 pivotably accommodated by the axis 2, shown inter alia in FIG. 1. The inertia mass 18 has a relatively large mass compared to the remaining components and is therefore referred an inertia mass. The inertia mass 18 is coupled to the actuator lever 16 via a spring 19. For coupling, a leg 20 of the spring 19 lies adjacent at the cam 17 of the actuator lever 16, while another leg 21 of the spring 19 lies adjacent on a protruding cam 22 of the inertia mass 18. By this coupling via the legs 20, 21 of the spring 19, a clockwise pivoting movement of the actuator lever 16 can be transmitted to the inertia mass 18 to pivot it in clockwise direction.

The actuator lever 16 can be pivoted around its axis 2 with aid of a drive 16*a*, as schematically shown in FIG. 1, which can be a motorized drive or an electromotor. If this occurs in a clockwise direction with sufficiently slight acceleration, this pivoting movement is thus transmitted without delay to the inertia mass 18. The actuator lever 16 and inertia mass 18 together then behave like a rigid body due to coupling via the spring 19. If the actuator lever 16 is pivoted by means of the drive in a clockwise direction with very much greater acceleration, this pivoting movement is not immediately transmitted to the inertia mass 18, as the greater acceleration results in compression of the spring. This acceleration-dependent behavior is used to pivot the coupling lever 4 either in its bolting position or to unratchet the pertaining locking mechanism and open pertaining doors.

In the starting position a lateral protrusion 23 of the inertia mass 18 is adjacent on the cam 17 of the actuator lever 16 (see FIG. 3). The lateral protrusion 23 has a ramped end 24. The free, pivotable end of the coupling lever 4 is located in the starting position of the ramped end 24. Between the ramped end 24 and the pivotable end of the coupling lever 4 there is, as shown in FIG. 3, a distance in the starting position of the activation device in order to assist speed-dependent behavior.

Figure 4:
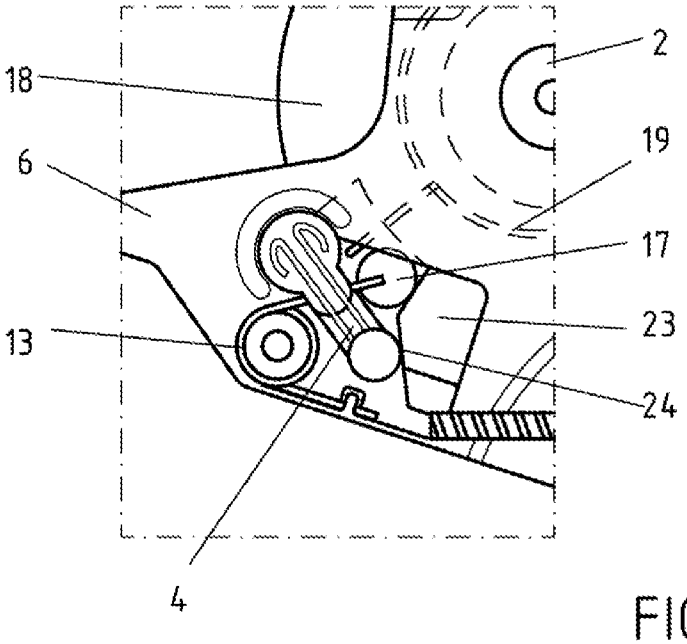
FIG. 4: Common pivoting of inertia mass and actuator lever for movement of the coupling lever in the direction of the bolting position.

If the actuator lever 16 is accelerated in a clockwise direction and pivoted at sufficiently low speed, the ramped end 24 moves in a delay-free manner on the freely pivotable end of the coupling lever 4 due to the coupling and finally captures this freely pivotable end. If the actuator lever 16 and thus also the inertia mass 18 are then pivoted further in a clockwise direction, the ramped end 24 deflects the coupling lever 4 and pivots it in a clockwise direction in the direction of the bolting position, as shown in excerpts in FIG. 4.

Figure 5:
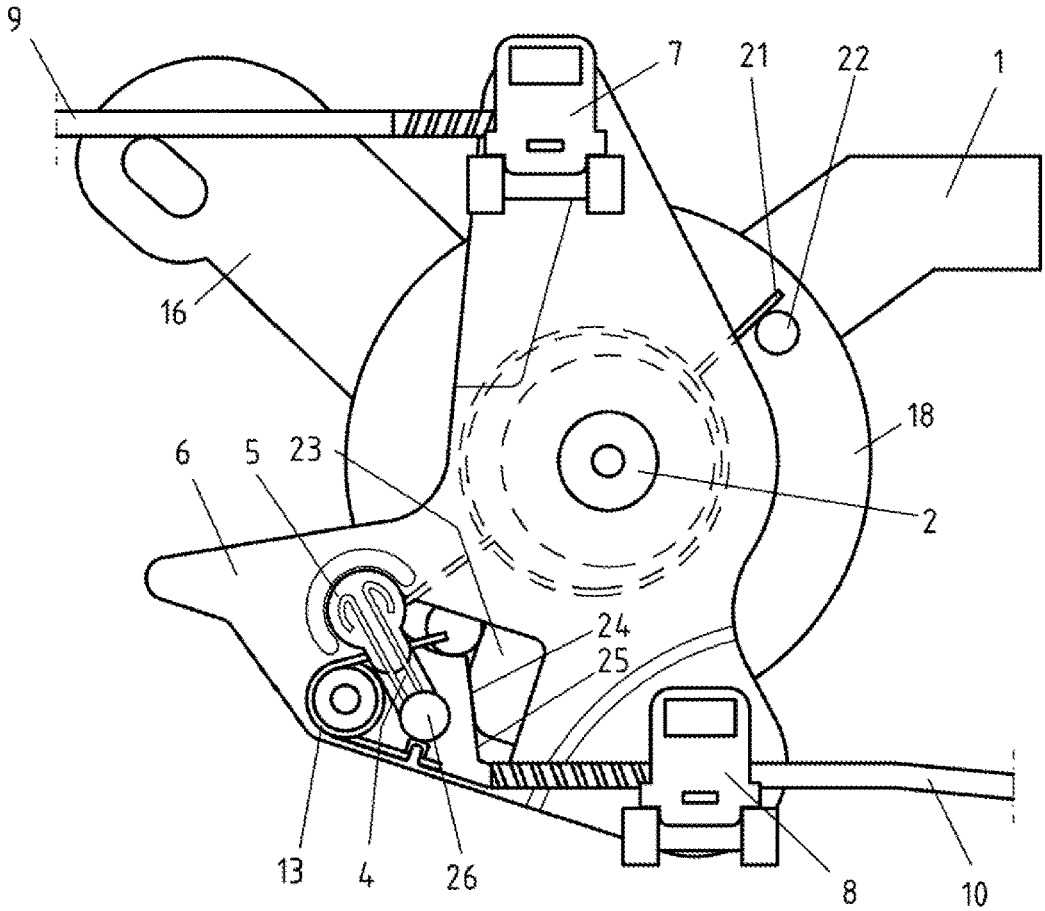
FIG. 5: Pivoting of inertia mass and actuator lever for movement of the coupling lever in the direction of the bolting position.

A ramped contour 25 of the actuator lever 16, shown in FIG. 5, is arranged behind the ramped end 24 of the inertia mass 18. The ramped contour 25 can be connected to the actuator lever 16 as a single component or attached to it as a separate component. Further slow rotational movement of the actuator lever 16 in the clockwise direction results in the ramped contour 25 finally taking over the freely-moving end of the coupling lever 4, as shown in FIG. 5. The ramped contour 25 pivots the coupling lever 4 further into its bolting position. However, the ramped end 24 can also be dimensioned in such a way that it is sufficient to move the coupling lever completely into its bolting position.

Figure 6:
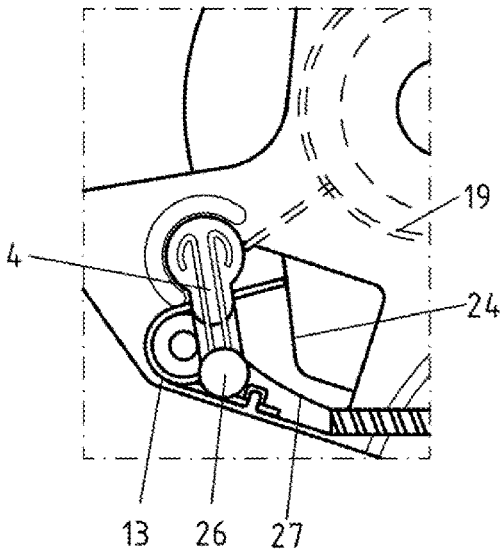
FIG. 6: Bolting position of the coupling lever.

The bolting position of the coupling lever 4 is shown in FIG. 6. The coupling lever 4 can encompass a unilaterally or bilaterally protruding bolt 26 at its free-moving end. With the aid of such a bolt 26 or in another manner, the free end of the coupling lever 4 is adjacent to an external contour 27 of the actuator lever 16 next to the ramped contour 25. The contour 27 of the actuator lever 16 holds the coupling lever 4 in its bolting position. The inertia mass 18 may have been blocked by a stop during this bolting movement, so that the inertia mass 18 with the ramped end 24 has not completely followed the movement of the actuator lever 16 with the ramped contour 25. The spring 19 has then been pre-tensioned in such a way that the pre-tensioning can be used to move the actuator lever 16 back into its starting position shown in FIG. 1 with the aid of the spring force.

Due to a sufficiently slowly accelerated, motorized pivoting of the actuator lever 16 bolting can therefore take place in a motorized manner.

Figure 7:
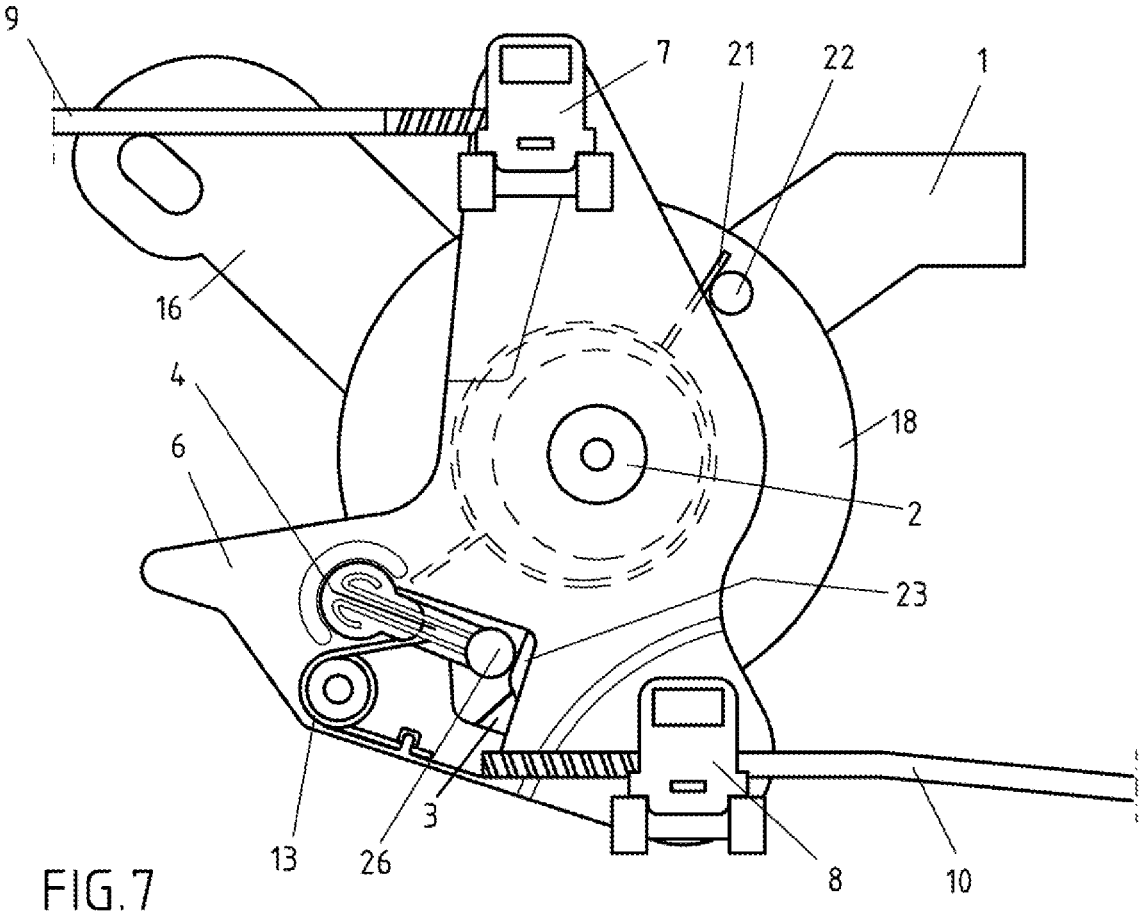
FIG. 7: Coupling lever in opening position enabling motorized unratcheting of a pertaining locking mechanism.

If the actuator lever 16 is accelerated sufficiently fast in a clockwise direction, the inertia mass 18 cannot follow this movement in a delay-free manner. A gap, shown in FIG. 7, then arises between the cam 17 (not visible in FIG. 7 as it is concealed by other components) of the actuator lever 16 and the protrusion 23 of the inertia mass 18. The force of the pre-tensioned leg spring 13 moves the freely moving end of the coupling lever 4 into this gap by pivoting in a counter-clockwise direction. The coupling lever 4 is then located in an open position which enables motorized unratcheting of a pertaining locking mechanism. If the inertia mass 18 subsequently follows the movement of the actuator lever 16 with delay, the protrusion 23 of the inertia mass 18 thus captures the free end of the coupling lever 4. The inertia mass 18 is then coupled with the opening lever 6 by the coupling lever 4 as shown in FIG. 7. Further rotation of the inertia mass 18 in a clockwise direction then causes pivoting of the opening lever 6 in a clockwise direction and thus in the opening direction. The locking mechanism connected by means of rods 9 and 10 is hereby opened.

REFERENCE SIGN LIST

1: External activation lever
2: Axis
3: Free lever end of the external activation lever
4: Coupling lever
5: Rotatable fixing of the coupling lever
6: Opening lever
7: Lever arm of the opening lever
8: Lever arm of the opening lever
9: Rod
10: Rod
11: Gap between the coupling lever and the external activation lever
12: Bolt protruding from the opening lever
13: Leg spring
14: Leg of the leg spring
15: Hook-shaped retaining element
16: Actuator lever
17: Cam protruding from the actuator lever
18: Inertia mass
19: Spring
20: Spring leg
21: Spring leg
22: Protruding cam of the inertia mass
23: Protrusion
24: Ramped end
25: Ramped contour of the actuator lever
26: Bolt of the coupling lever
27: Contour of the actuator lever

What is claimed is:

1. A motor vehicle latching system comprising: an actuator lever; and a motorized drive for pivoting the actuator lever with a first acceleration and a second acceleration that is greater than the first acceleration, wherein the actuator lever adjusts the latching system, dependent on acceleration, wherein acceleration of the actuator lever with the first acceleration results in bolting of the motor vehicle latching system, and wherein acceleration of the actuator lever with the second acceleration results in opening of the motor vehicle latching system.

2. The motor vehicle latching system according to claim 1 further comprising an external activation lever, an inertia mass, and/or an opening lever that are pivotably mounted on an axis along with the actuator lever.

3. The motor vehicle latching system according to claim 1 further comprising an inertia mass coupled with the actuator lever via a spring.

4. The motor vehicle latching system according to claim 1 further comprising an external activation element that unratchets a locking mechanism of the latching system by manual activation if the latching system is not bolted.

5. The motor vehicle latching system according to claim 2, wherein a coupling lever is pivotably attached to the opening lever.

6. The motor vehicle latching system according to claim 4, wherein the external activation element is moved by activation and that, starting from a starting position of the latching system, movement of the external activation element is transmitted by a coupling lever to an opening lever and movement of the opening lever unratchets the locking mechanism of the motor vehicle latching system.

7. The motor vehicle latching system according to claim 6, wherein the opening lever has two opposite lever arms which can be connected to the locking mechanism for unratcheting.

8. The motor vehicle latching system according to claim 6, wherein the coupling lever is separated in the starting position from the external activation element by a gap.

9. The motor vehicle latching system according to claim 6, wherein via the first or second acceleration of the actuator lever, the coupling lever is moved from the starting position into a bolting position for bolting the motor vehicle latching system.

10. The motor vehicle latching system according to claim 9, wherein the opening lever has two opposite lever arms for unratcheting, wherein at least one of the two lever arms is connected to the locking mechanism of the motor vehicle latching system.

11. The motor vehicle latching system at least according to claim 6 further comprising an inertia mass that encompasses a ramped end, by which the coupling lever can be pivoted in a direction of a bolting position.

12. The motor vehicle latching system according to claim 11, wherein the inertia mass can be coupled with the opening lever for motorized unratcheting of the locking mechanism by the coupling lever.

13. The motor vehicle latching system according to claim 12, wherein the inertia mass is coupled with the opening lever for motorized unratcheting of the locking mechanism by pivoting of the coupling lever into an open position, wherein the inertia mass can only follow the actuator lever having the second acceleration in a delayed manner.

14. The motor vehicle latching system according to claim 13, wherein the coupling lever can be pivoted into the open position with a force of a pre-tensioned spring to couple the inertia mass with the opening lever for motorized unratcheting of the locking mechanism.

15. The motor vehicle latching system according to claim 12, wherein the coupling lever can be pivoted into an open position with force of a pre-tensioned spring to couple the inertia mass with the opening lever for motorized unratcheting of the locking mechanism.

* * * * *